US007628387B1

(12) United States Patent
Clouse et al.

(10) Patent No.: US 7,628,387 B1
(45) Date of Patent: Dec. 8, 2009

(54) ENGINE AIR/FUEL MIXING APPARATUS

(75) Inventors: Max W. Clouse, Watertown, WI (US); Aaron Halfmann, Germantown, WI (US); David Roth, North Fond du Lac, WI (US); James J. Dehn, Brookfield, WI (US); Kyle R. Clasen, West Allis, WI (US); Donald Szopinski, Hartland, WI (US); Matthew A. Martinek, Cedarburg, WI (US); Brian R. Paul, West Bend, WI (US); James D. Makiya, Wauwatosa, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 15 days.

(21) Appl. No.: 12/167,487

(22) Filed: Jul. 3, 2008

(51) Int. Cl.
*F02M 1/10* (2006.01)

(52) U.S. Cl. ..... 261/39.1; 261/52; 261/DIG. 74

(58) Field of Classification Search ..... 261/39.1, 261/52, 64.1, 65, DIG. 74
See application file for complete search history.

(56) References Cited

U.S. PATENT DOCUMENTS

| | | | |
|---|---|---|---|
| 3,272,486 | A | 9/1966 | Lucas et al. |
| 3,534,720 | A | 10/1970 | DuBois |
| 3,562,542 | A | 2/1971 | Redmond |
| 3,625,492 | A | 12/1971 | Reichenbach et al. |
| 3,740,040 | A | 6/1973 | Brown, III et al. |
| 3,791,358 | A | 2/1974 | Masaki et al. |
| 3,834,677 | A | 9/1974 | Hosho |
| 3,863,614 | A | 2/1975 | Thompson et al. |
| 3,868,935 | A | 3/1975 | Liebman et al. |
| 3,895,615 | A | 7/1975 | Schubeck |
| 3,948,240 | A | 4/1976 | Hirosawa et al. |
| 3,957,026 | A | 5/1976 | Winkley et al. |
| 3,960,130 | A | 6/1976 | Peterson, Jr. |
| 3,978,835 | A | 9/1976 | Fenton |
| 4,011,844 | A | 3/1977 | Hirosawa et al. |
| 4,031,872 | A | 6/1977 | Thompson et al. |
| 4,033,712 | A | 7/1977 | Morton |
| 4,094,292 | A | 6/1978 | Takagi et al. |
| 4,096,212 | A | 6/1978 | Rogerson et al. |
| 4,096,843 | A | 6/1978 | Marsee |
| 4,113,808 | A | 9/1978 | Hackbarth et al. |
| 4,114,584 | A | 9/1978 | Rogerson et al. |
| 4,137,283 | A | 1/1979 | Couderc |
| 4,151,499 | A | 4/1979 | Ganowsky et al. |

(Continued)

FOREIGN PATENT DOCUMENTS

| | | |
|---|---|---|
| EP | 0113268 | 7/1984 |

(Continued)

*Primary Examiner*—Richard L Chiesa
(74) *Attorney, Agent, or Firm*—Michael Best & Friedrich LLP

(57) ABSTRACT

An air/fuel mixing apparatus, configured for use with an internal combustion engine, includes a body defining a passageway therein, a throttle lever including a cam surface, a throttle valve positioned in the passageway and responsive to movement of the throttle lever, a choke lever including a follower surface configured to be engaged by the cam surface, and a choke valve positioned in the passageway and responsive to movement of the choke lever and the throttle lever. The air/fuel mixing apparatus also includes a solenoid configured to disengage the choke lever from the throttle lever, and move the choke valve to a substantially-opened position.

15 Claims, 8 Drawing Sheets

U.S. PATENT DOCUMENTS 4,177,784 A 12/1979 Tatsutomi et al.
4,181,107 A 1/1980 Nomura et al.
4,186,697 A 2/1980 Yasuda et al.
4,196,156 A 4/1980 Rogerson et al.
4,271,802 A 6/1981 Hori et al.
4,321,902 A 3/1982 Stoltman
4,347,196 A * 8/1982 Kenma ..... 261/39.3
4,351,782 A 9/1982 Bellicardi et al.
4,391,249 A 7/1983 Bianchi et al.
4,442,811 A 4/1984 Shimamura et al.
4,463,723 A 8/1984 Tansuwan
4,465,640 A 8/1984 Dougherty
4,474,009 A 10/1984 Fried et al.
4,500,478 A 2/1985 Furukawa et al.
4,524,742 A 6/1985 Bonfiglioli et al.
4,627,401 A * 12/1986 Brandner et al. ..... 123/439
4,662,333 A 5/1987 Martel
4,672,929 A 6/1987 Wissmann et al.
4,768,478 A 9/1988 Martel
4,773,362 A 9/1988 Wissmann et al.
4,854,283 A 8/1989 Kiyono et al.
5,027,769 A 7/1991 Yoshida et al.
5,069,180 A 12/1991 Schmidt et al.
5,235,943 A 8/1993 Fiorenza, II
5,503,125 A 4/1996 Gund
5,511,519 A 4/1996 Watson et al.
5,537,964 A 7/1996 Hoshiba
5,542,388 A 8/1996 Ichinose et al.
5,596,957 A 1/1997 Ichinose et al.
5,611,312 A 3/1997 Swanson et al.
5,660,765 A 8/1997 King et al.
5,676,102 A 10/1997 Ichinose et al.
5,704,324 A 1/1998 Ichinose et al.
5,827,455 A 10/1998 Nakai
5,832,888 A 11/1998 Griffiths et al.
6,012,420 A 1/2000 Dykstra et al.
6,098,594 A 8/2000 Kowatari et al.
6,145,487 A 11/2000 Dykstra et al.
6,202,989 B1 * 3/2001 Pattullo ..... 261/52
6,371,080 B1 4/2002 Saito et al.
6,401,690 B1 6/2002 Kowatari et al.
6,439,547 B1 8/2002 King et al.
6,488,010 B2 12/2002 Saito et al.
6,752,110 B2 6/2004 Tharman et al.
6,830,023 B2 12/2004 Tharman et al.
6,848,405 B1 2/2005 Dow et al.
6,990,940 B2 1/2006 Sakurai
6,990,969 B2 1/2006 Roth et al.
7,117,834 B2 10/2006 Kamimura et al.
7,144,000 B2 12/2006 Roth et al.
7,171,947 B2 2/2007 Fukushima et al.
7,213,555 B2 5/2007 Kamimura et al.
7,246,591 B2 7/2007 Shinogi et al.
7,284,522 B2 10/2007 Kamimura et al.
7,331,326 B2 2/2008 Arai et al.
7,344,125 B2 * 3/2008 Matsuda et al. ..... 261/64.1
2004/0055554 A1 3/2004 Tharman et al.
2005/0205039 A1 9/2005 Kamimura et al.
2006/0037574 A1 2/2006 Matsuda et al.
2006/0038305 A1 * 2/2006 Bungo et al. ..... 261/64.1
2006/0043621 A1 * 3/2006 Roth et al. ..... 261/52
2007/0012287 A1 1/2007 Shinogi et al.

FOREIGN PATENT DOCUMENTS

JP 52-39037 A * 3/1977
JP 52-53147 A * 4/1977
JP 54121336 9/1979
JP 55032971 3/1980
JP 55134737 10/1980
JP 57070938 5/1982
JP 57165648 10/1982
JP 60138259 7/1985
JP 62051744 3/1987
JP 01029659 1/1989
JP 01285647 11/1989
JP 4116256 4/1992

* cited by examiner

ENGINE AIR/FUEL MIXING APPARATUS

FIELD OF THE INVENTION

The present invention relates to internal combustion engines, and more particularly to carburetors and starting assists for internal combustion engines.

BACKGROUND OF THE INVENTION

In small internal combustions engine utilizing a carburetor, such as those engines in a lawnmower, a snowblower, or other outdoor power equipment, the engine may include a choke assembly that provides a rich air/fuel mixture for facilitating engine starting. In many small engines, the choke assembly is actuated manually. However, some small engines are configured with an automatic choke assembly utilizing, for example, a thermally-responsive mechanism to control the choke opening. For cold engine temperatures (e.g., during initial engine starting), the choke valve is closed to reduce the air flow to the engine to enrich the air/fuel mixture. For higher engine temperatures (e.g., during normal engine operation or a hot restart of the engine), the choke valve is opened because the engine no longer requires a rich air/fuel mixture.

SUMMARY OF THE INVENTION

The present invention provides, in one aspect, an air/fuel mixing apparatus configured for use with an internal combustion engine, including a carburetor having a body defining a passageway therein, a throttle lever including a cam surface, a throttle valve positioned in the passageway and responsive to movement of the throttle lever, a choke lever including a follower surface configured to be engaged by the cam surface, and a choke valve positioned in the passageway and responsive to movement of the choke lever and the throttle lever. The air/fuel mixing apparatus also includes a solenoid configured to disengage the choke lever from the throttle lever, and move the choke valve to a substantially-opened position.

Other features and aspects of the invention will become apparent by consideration of the following detailed description and accompanying drawings.

Figure 1:
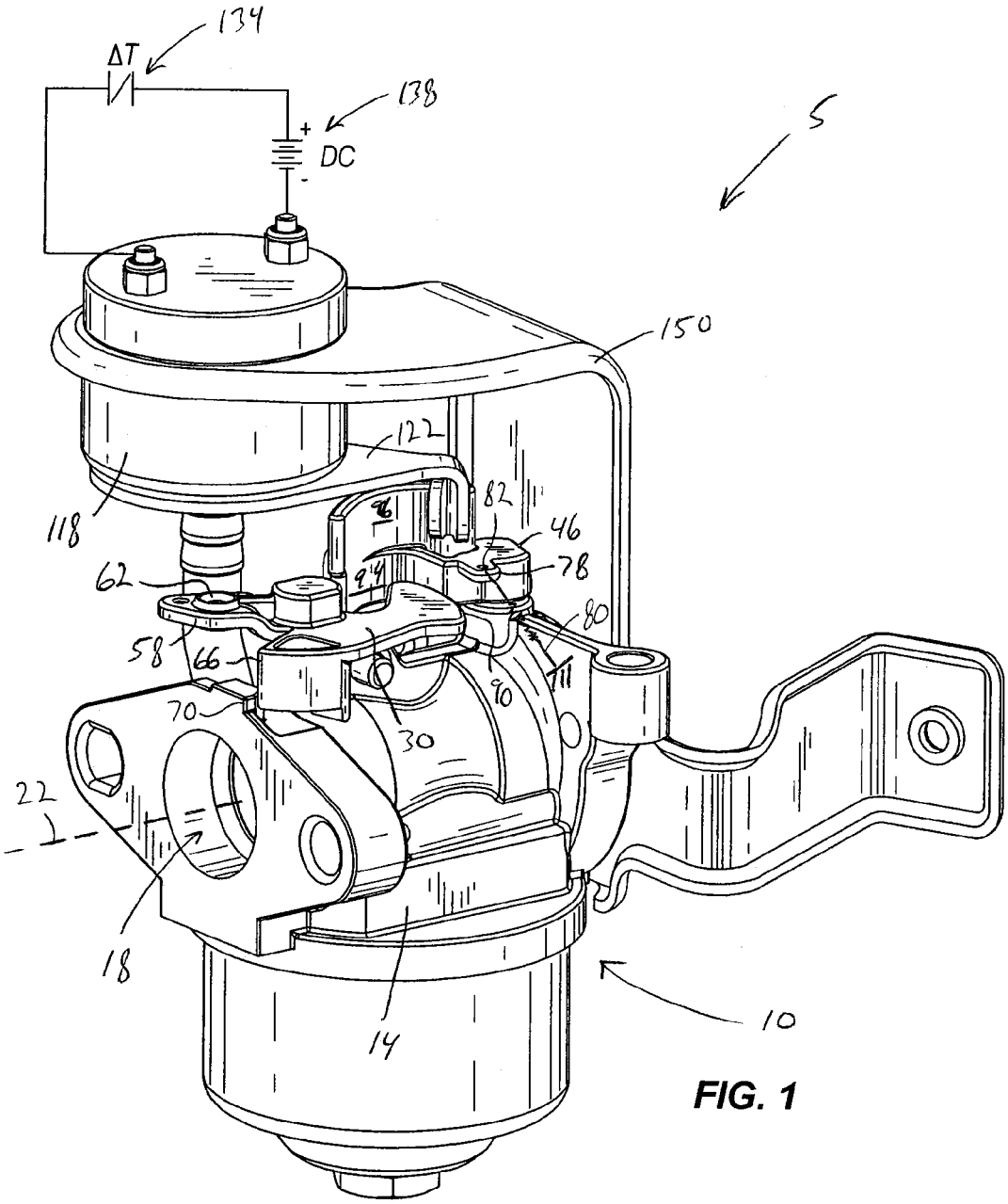
FIG. 1 is a rear perspective view of an air/fuel mixing device of the present invention including a carburetor and solenoid, illustrating a throttle valve in a fully-opened position and a choke valve in a fully-closed position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

FIGS. 1-6 illustrate an air/fuel mixing apparatus 5, configured for use with a small internal combustion engine, including a carburetor 10 and a solenoid 118. Such an engine may be utilized in outdoor power equipment (e.g., a lawnmower, snowblower, etc.) or other types of engine-powered equipment (e.g., a generator). The carburetor 10 includes a body 14 defining an air/fuel passageway 18 along a central axis 22. The carburetor 10 also includes a throttle valve 26 positioned in the passageway 18 and a throttle lever 30 coupled to the throttle valve 26 via a throttle shaft 34. The throttle valve 26, throttle shaft 34, and throttle lever 30 are pivotable about an axis 38 oriented substantially normal to the central axis 22 of the passageway 18. With continued reference to FIGS. 1-6, the carburetor 10 also includes a choke valve 42 positioned in the passageway 18 and a choke lever 46 coupled to the choke valve 42 via a choke shaft 50. The choke valve 42, choke shaft 50, and choke lever 46 are also pivotable about an axis 54 oriented substantially normal to the central axis 22 of the passageway 18.

With reference to FIGS. 1-6, the throttle lever 30 includes an arm 58 coupled to a governor lever (not shown) of the engine, which, in turn, is selectively actuated by another component of a governor in the engine to open and close the throttle valve 26. In the illustrated construction of the throttle lever 30, the arm 58 includes an aperture 62 to facilitate coupling of the governor lever to the throttle lever 30 (e.g., by a fastener). Alternatively, the arm 58 may be coupled to the governor lever in any of a number of different ways.

The throttle lever 30 also includes a stop 66 configured to engage different portions of the body 14 to limit the extent to which the throttle valve 26 may be opened and closed. In the illustrated construction of the air/fuel mixing apparatus 5, the stop 66 engages a protrusion 70 on the body 14 to limit the opening of the throttle valve 26, and a screw 72 threaded to a portion of the body 10 to limit the closing of the throttle valve 26 (see FIG. 2). The protrusion 70 may be sized and positioned to limit the opening of the throttle valve 26 to a throttle angle A1 of about 90 degrees measured from a plane 74 normal to the central axis 22 of the passageway 18. In other words, the protrusion 70 may be sized and positioned to limit the opening of the throttle valve 26 to an orientation in which the throttle valve 26 is substantially parallel to the central axis 22. In this position, the throttle valve 26 is "wide open" or fully opened to allow the maximum amount of airflow through the passageway 18. The screw 72 may be adjusted relative to the body 14, for example, to limit the closing of the throttle valve 26 to a throttle angle A2 of about 15 degrees measured from the plane 74 (i.e., about 75 degrees "closed," from the fully-opened position of the throttle valve 26 shown in FIG. 2; see FIG. 4). Alternative constructions of the carburetor 10 may utilize any of a number of different structures and components to limit the opening and closing of the throttle valve 26.

With reference to FIGS. 1-6, the choke lever 46 includes an arm 78 coupled to a biasing member (e.g., a spring 80). The arm 78 includes an aperture 82 through which a portion of the spring 80 may be inserted to couple the spring to the arm 78. The arm 78 is positioned on the choke lever 46 such that the spring 80 can apply a torque on the choke lever 46 about its axis 54 in a counter-clockwise direction, as shown in FIGS. 2-4 and 6, to bias the choke valve 42 toward a closed position. In the illustrated construction of the air/fuel mixing apparatus 5, the closed position of the choke valve 42 corresponds with an angle A3 of about 75 degrees with respect to the central axis 22 (see FIG. 2). Alternatively, the carburetor 10 may be configured such that the closed position of the choke valve 42 corresponds with an angle A3 with respect to the central axis 22 more or less than about 75 degrees.

With continued reference to FIGS. 2-4 and 6, the throttle lever 30 includes a cam surface 90 engaged with a follower surface 94 of the choke lever 46. The cam surface 90 includes an arcuate segment 98 having a constant radius R centered on an axis 102 substantially parallel with the axis 38 of the throttle lever 30. In the illustrated construction of the air/fuel mixing apparatus 5, the axis 102 is coaxial with the axis 38 of the throttle lever 30, such that a vector of the reaction force applied to the cam surface 90 by the follower surface 94, at any point along the arcuate segment 98, passes through or intersects the axis 38 of the throttle lever 30. Such a vector is also normal to a line tangent to the cam surface 90 and the follower surface 94 at that point of the arcuate segment 98.

With reference to FIGS. 1-6, the choke lever 46 includes a second follower surface 96 disposed adjacent the follower surface 94. Specifically, the follower surface 96 is located above the follower surface 94. In the illustrated construction of the air/fuel mixing apparatus 5, the portion of the follower surface 96 adjacent the distal end of the choke lever 46 is blended with the portion of the follower surface 94 adjacent the distal end of the choke lever 46. Alternatively, the choke lever 46 may be configured such that the entire lengths of the respective follower surfaces 94, 96 are separate and distinct from each other.

Figure 2:
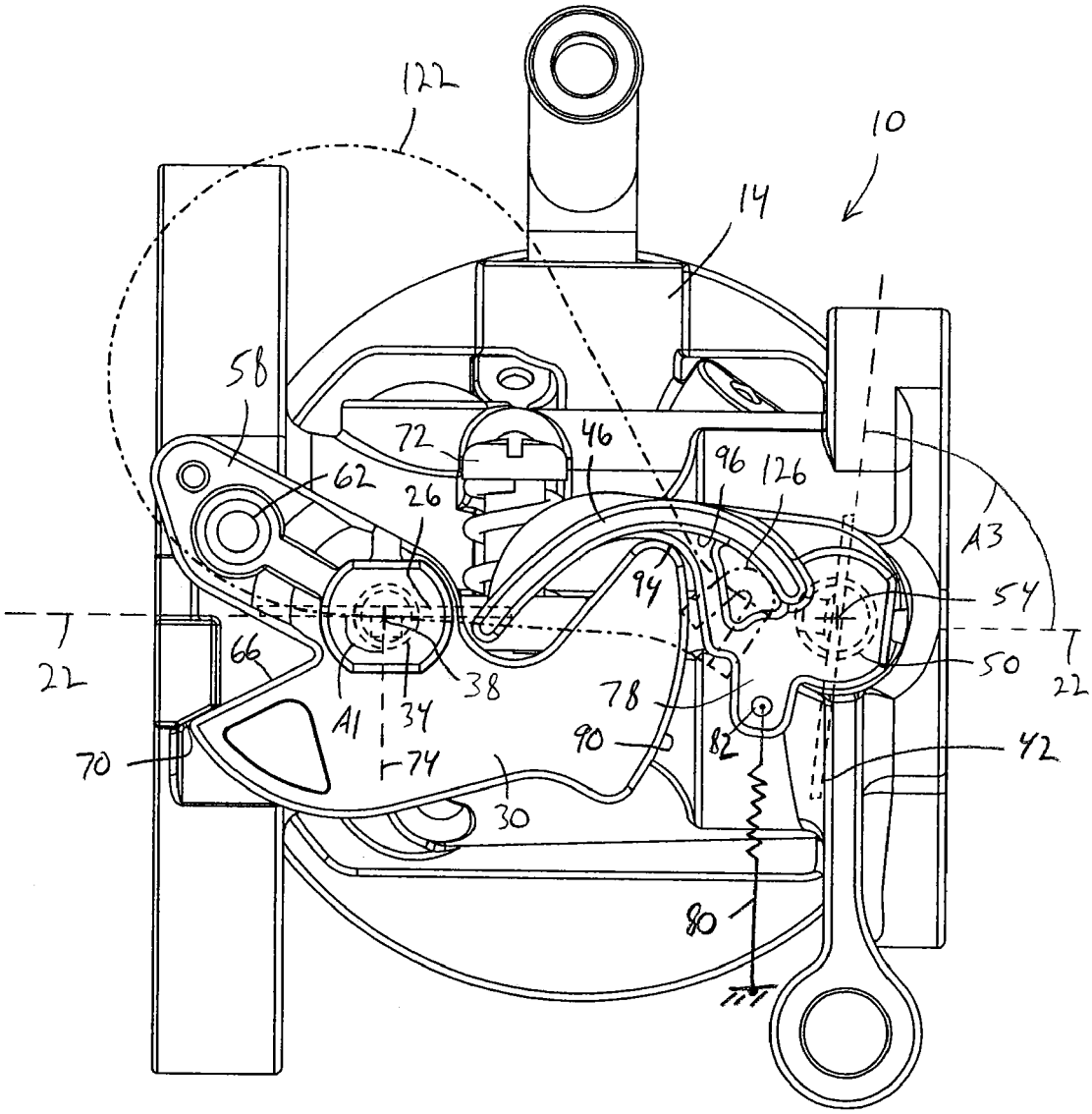
FIG. 2 is a top view of the carburetor of FIG. 1, with portions of the solenoid removed for clarity.
Figure 3:
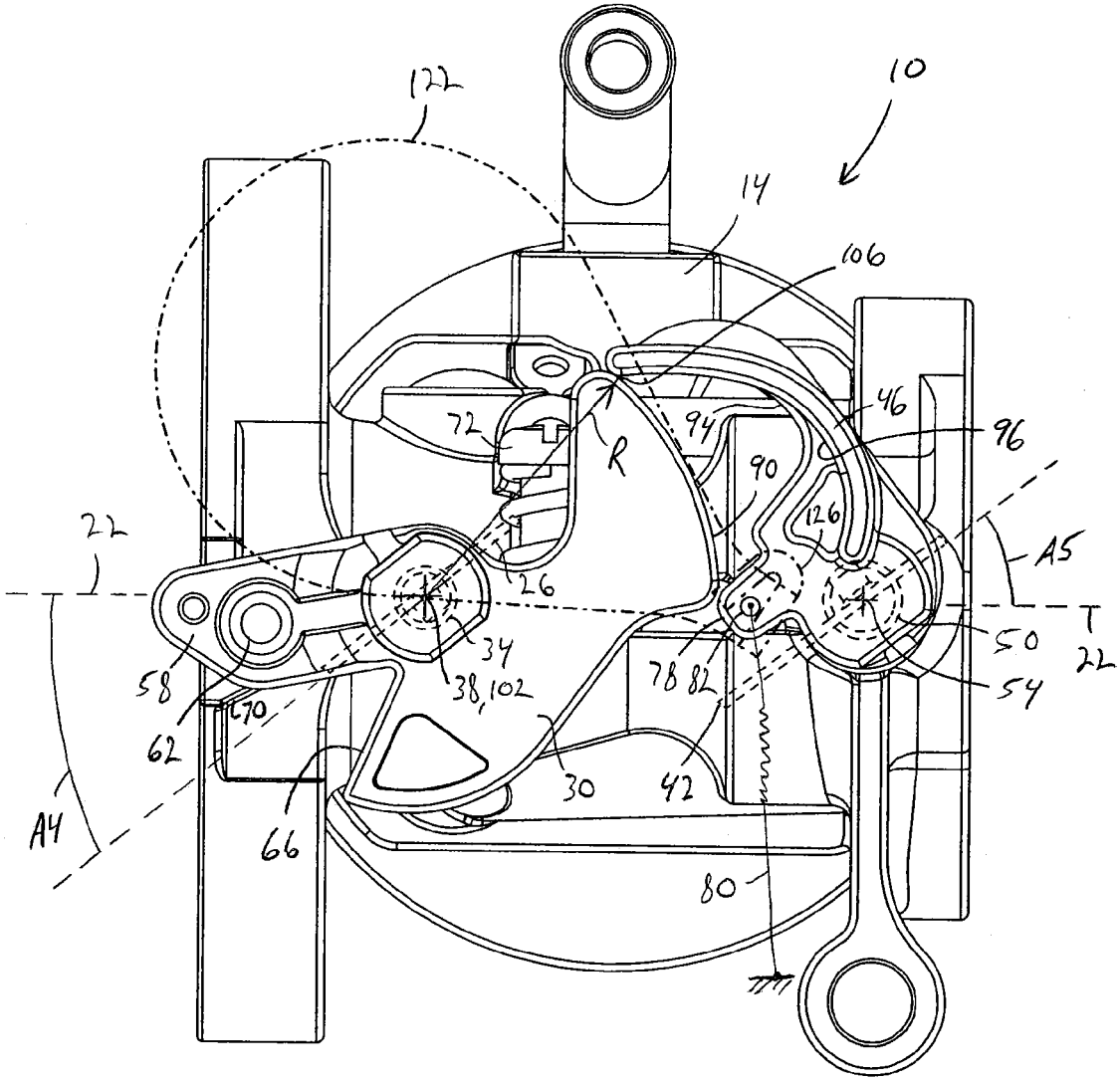
FIG. 3 is a top view of the carburetor of FIG. 1, with portions of the solenoid removed for clarity, illustrating the throttle valve in a first partially-opened position and the choke valve in a partially-opened position.

With reference to the illustrated construction of the air/fuel mixing apparatus 5 shown in FIG. 3, a first end 106 of the arcuate segment 98 substantially coincides with a throttle valve angle A4 of about 39 degrees from the central axis 22. In other words, the follower surface 94 engages the cam surface 90 at a location coincident with the first end 106 of the arcuate segment 98 when the throttle valve 26 is moved to a throttle valve angle of about 39 degrees from the fully-opened position of the throttle valve 26 shown in FIG. 2. Alternatively, the carburetor 10 may be configured such that the first end 106 of the arcuate segment 98 coincides with a throttle valve angle A4 greater than or less than about 39 degrees from the central axis 22. With reference to FIG. 3, the choke valve 42 is opened to an angle A5, relative to the central axis 22, of about 40 degrees when the throttle valve 26 is rotated to the throttle valve angle A4 of about 39 degrees. Alternatively, the follower surface 94 may be differently configured, depending upon the expected ambient temperature experienced by the engine incorporating the air/fuel mixing apparatus 5, to open the choke valve 42 to an angle A5 greater or less than about 40 degrees when the throttle valve angle A4 is about 39 degrees.

Figure 4:
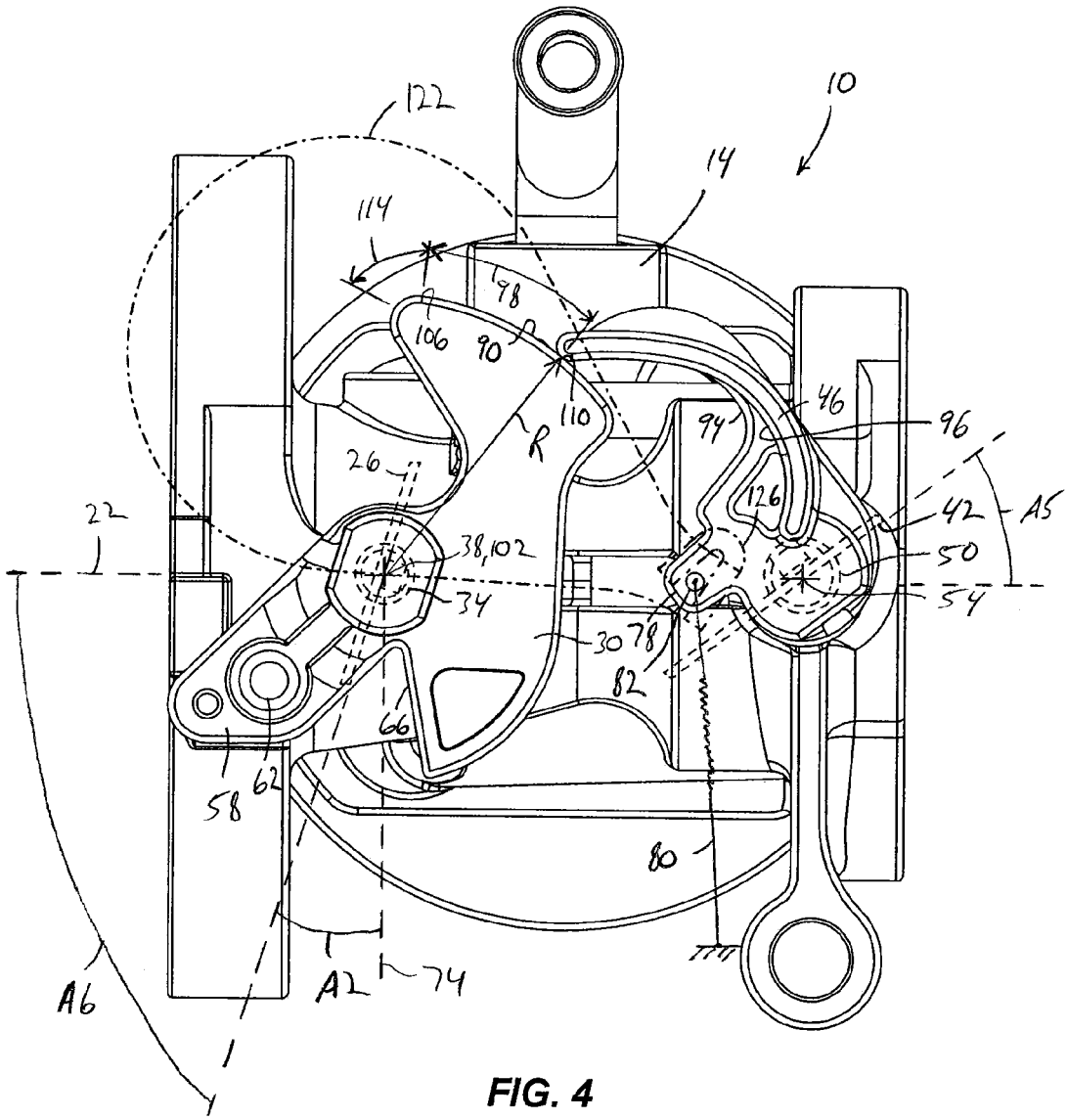
FIG. 4 is a top view of the carburetor of FIG. 1, with portions of the solenoid removed for clarity, illustrating the throttle valve in a second partially-opened position and the choke valve in its partially-opened position.

With reference to the illustrated construction of the air/fuel mixing apparatus 5 shown in FIG. 4, a second end 110 of the arcuate segment 98 substantially coincides with a throttle valve angle A6, corresponding with the fully-closed position of the throttle valve 26, of about 75 degrees from the central axis 22, and at least about 50 degrees from the central axis 22. In other words, the follower surface 94 engages the cam surface 90 at a location coincident with the second end 110 of the arcuate segment 98 when the throttle valve 26 is moved to a throttle valve angle of about 75 degrees from the fully-opened position of the throttle valve 26 shown in FIG. 2 (see FIG. 4). Alternatively, the carburetor 10 may be configured such that the second end 110 of the arcuate segment 98 coincides with a throttle valve angle A6 greater than or less than about 75 degrees from the central axis 22. In operation of the engine incorporating the air/fuel mixing apparatus 5, however, the screw 72 may be adjusted to limit the throttle valve angle A6 to a value less than about 75 degrees. With continued reference to FIG. 4, because the radius R of the arcuate segment 98 is constant, the orientation of the choke valve 42 is substantially unchanged during rotation of the throttle valve 26 from angle A4 (FIG. 3) to angle A6 (FIG. 4). The opening angle A5 of the choke valve 42 is determined by a range of expected ambient temperatures during engine operation, and the corresponding air/fuel ratios at those temperatures. The choke valve 42 remains at this opening angle A5 until the engine incorporating the air/fuel mixing apparatus 5 reaches normal operating temperature.

As such, the follower surface 94 engages the arcuate segment 98 over about 36 degrees of throttle valve opening, from the position of the throttle valve 26 shown in FIG. 3 to the position of the throttle valve 26 shown in FIG. 4. Alternatively, the arcuate segment 98 of the cam surface 90 may include a length less than that shown in FIGS. 2-4 and 6, such that the follower surface 94 engages the arcuate segment 98 less than about 36 degrees, but at least 15 degrees, of throttle valve opening. Further, the arcuate segment 98 of the cam surface 90 may include a length greater than that shown in FIGS. 2-4 and 6, such that the follower surface 94 engages the arcuate segment 98 more than about 36 degrees of throttle valve opening.

In an engine incorporating the carburetor 10 of FIGS. 1-6, the throttle lever 30 is biased toward the position shown in FIG. 2 by the governor lever or a biasing member (e.g., a return spring) to orient the throttle valve 26 in a wide-open or fully-opened position in preparation for a cold-start of the engine. In addition, the choke lever 46 is biased toward the position shown in FIG. 2 (e.g., by the spring 80) to orient the choke valve 42 in a closed position in preparation for a cold-start of the engine. Immediately after start-up of the engine, the governor actuates the governor lever to move the throttle lever 30 in a counter-clockwise direction, as shown in FIGS. 3 and 4, to move the throttle valve 26 to a particular position or throttle valve angle to achieve a desired no-load operating speed of the engine. In the illustrated configuration of the carburetor 10 in FIG. 4, the desired no-load operating speed of the engine is achieved by moving the throttle valve 26 to a position where it is about 75 degrees from the fully-opened position of the throttle valve 26 shown in FIG. 2. Alternatively, the carburetor 10 may be configured such that the desired no-load operating speed of the engine is achieved at a throttle valve angle corresponding with engagement of the cam surface 90 and follower surface 94 anywhere along the arcuate segment 98.

With reference to FIGS. 2-4, as the throttle lever 30 is pivoted from its position shown in FIG. 2 to its position shown in FIG. 4, the throttle lever 30 applies a force on the choke lever 46 to open the choke valve 42. As previously discussed, the choke lever 46 is biased (e.g., by a spring) to a position in which the choke valve 42 is closed (see FIG. 2). As a result, the choke lever 46 applies a reaction force on the throttle lever 30 along a vector normal to a line tangent to both the cam surface 90 and the follower surface 94. When the reaction force vector is non-collinear with the axis 38 of the throttle lever 30, the reaction force imparts a reaction torque on the throttle lever 30. FIG. 4 illustrates a range of engagement 114 of the cam surface 90 and the follower surface 94 along which the reaction force vector is non-collinear with the axis 38 of the throttle lever 30. The magnitude of the reaction torque is dependent upon the geometry of the throttle lever 30 and the choke lever 46, and the spring rate of the spring biasing the choke lever 46.

With reference to FIGS. 3 and 4, however, the constant radius R of the arcuate segment 98 ensures that the vector of the reaction force applied to the cam surface 90 by the follower surface 94 is aligned with (i.e., collinear) or intersects the axis 38 of the throttle lever 30. As a result, the reaction force applied to the throttle lever 30 cannot impart a corresponding reaction torque on the throttle lever 30 to impede or otherwise affect the movement of the throttle lever 30 within the range of engagement of the cam surface 90 and follower surface 94 along the arcuate segment 98. By substantially eliminating the reaction torque on the throttle lever 30 within the range of engagement of the cam surface 90 and follower surface 94 along the arcuate segment 98, the carburetor 10 may be configured to provide a wide range of selected desired no-load operating speeds of an engine within which interference with the governor's control of the throttle lever 30 is minimized or prevented. In addition, the throttle lever 30 may move within the range of engagement of the cam surface 90 and follower surface 94 along the arcuate segment 98 in response to engine loading, without substantial interference with the governor's control of the throttle lever 30 by the reaction force applied to the throttle lever 30 by the choke lever 46.

Figure 5:
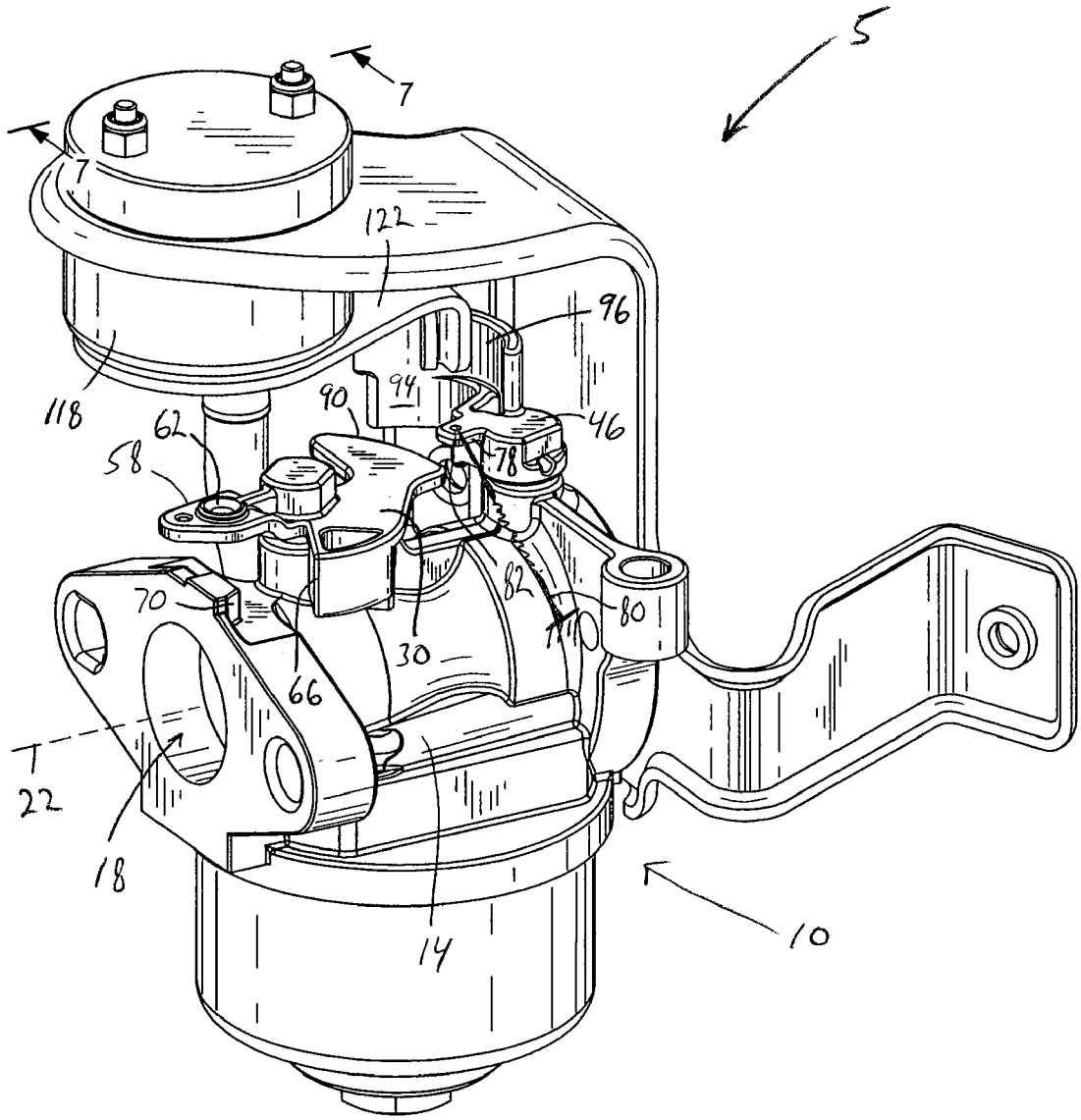
FIG. 5 is a rear perspective view of the carburetor and solenoid of FIG. 1, illustrating the solenoid energized to disengage a choke lever from a throttle lever of the carburetor to fully open the choke valve.
Figure 6:
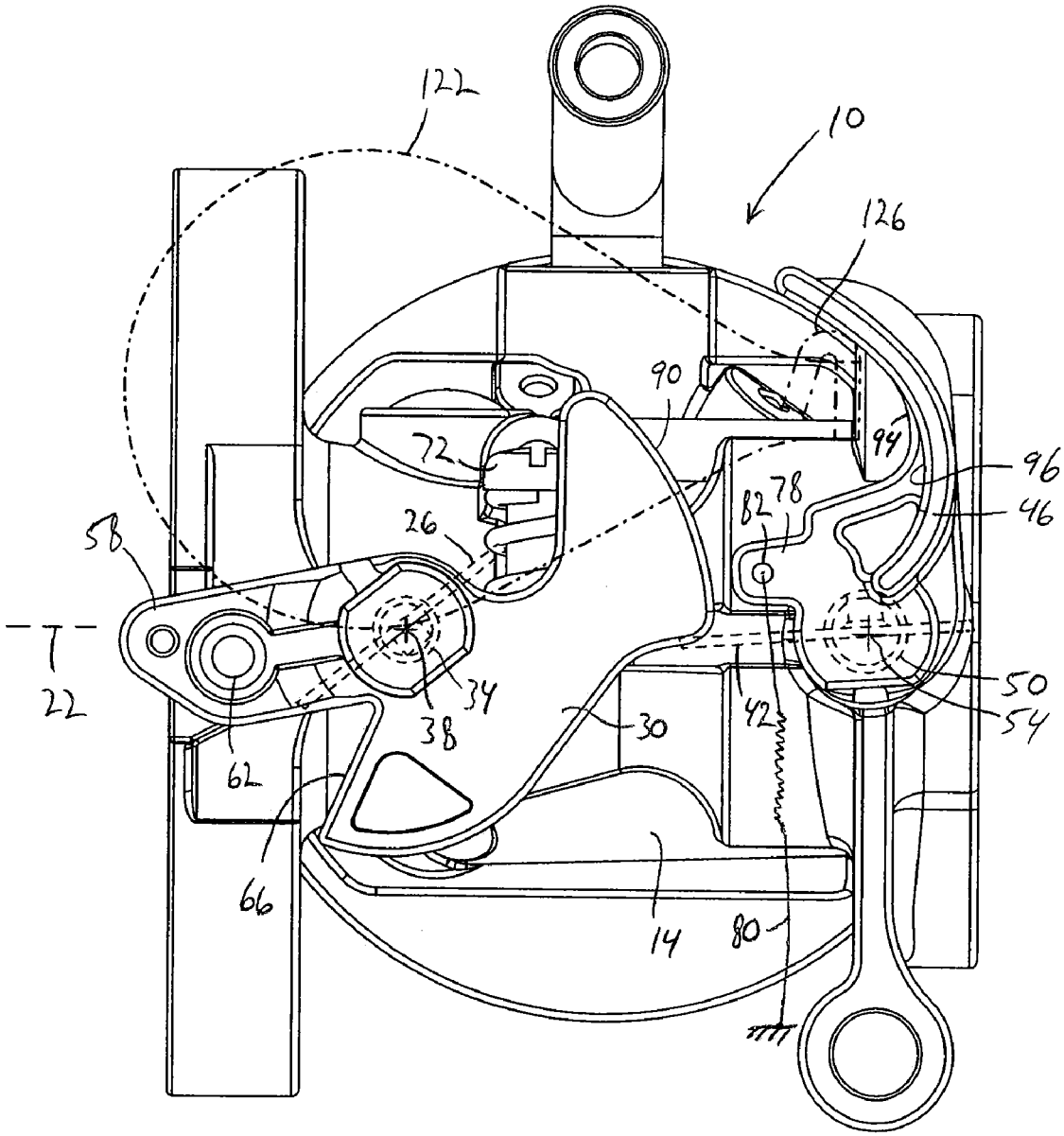
FIG. 6 is a top view of the carburetor of FIG. 5, with portions of the solenoid removed for clarity.
Figure 7:
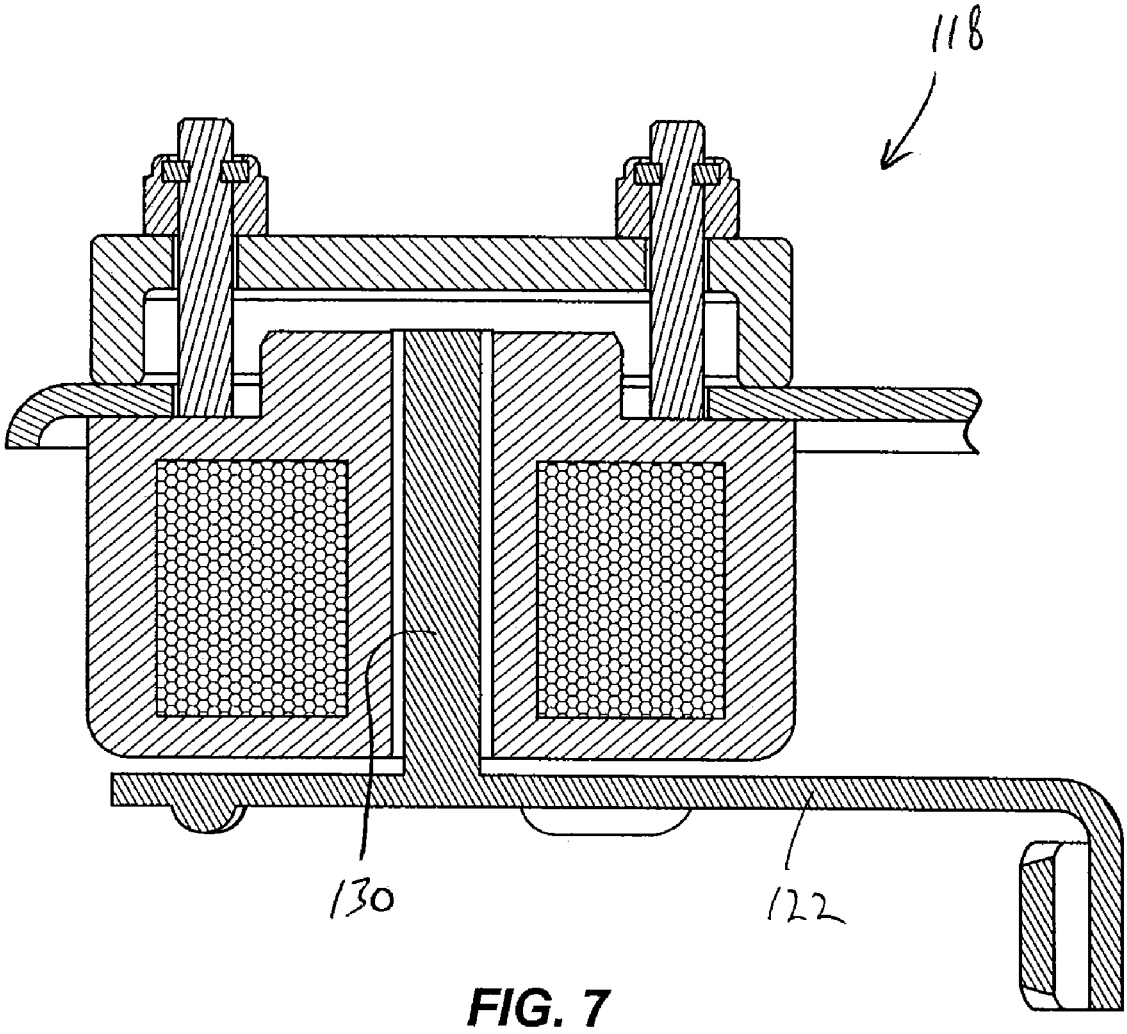
FIG. 7 is a cross-sectional view of the solenoid of FIG. 1, taken along line 7-7 in FIG. 5.

With reference to FIGS. 5 and 6, after the engine has started and has reached its normal operating temperature, a rotary solenoid 118 may be activated to further pivot the choke lever 46 to disengage the choke lever 46 from the throttle lever 30, and maintain the choke lever 46 in a position in which the choke valve 42 is substantially opened. With reference to FIG. 5, the rotary solenoid 118 includes a lever 122 having a cam surface 126 at the distal end of the lever 122 (see also FIG. 6). In the illustrated construction of the solenoid 118, the lever 122 is integrally formed as a single piece with an output shaft or an armature 130 of the solenoid 118 (see FIG. 7). Alternatively, the lever 122 may be a separate and distinct component from the armature 130, and coupled to the armature 130 in any of a number of different ways (e.g., by a key and keyway arrangement, by a press-fit, etc.).

With reference to FIG. 6, upon actuation of the solenoid 118, the lever 122 is rotated about the axis of the armature 130, and the cam surface 126 of the lever 122 is engaged with the follower surface 96 of the choke lever 46 to pivot the choke lever 46 out of engagement with the throttle lever 30. The profile of the follower surface 96 is shaped to minimize the required torque output from the solenoid 118 to actuate and hold the choke valve 42 in its substantially-opened position. Such a rotary solenoid 118 is available from Johnson Electric, Inc. of Vandalia, Ohio under the trade name Ledex® (www.ledex.com).

By disengaging the choke lever 46 and the throttle lever 30, mechanical feedback from the choke lever 46 to the throttle lever 30 is eliminated. Such mechanical feedback might otherwise negatively affect engine performance. Likewise, mechanical feedback from the throttle lever 30 to the choke lever 46 is eliminated. By rotating the choke valve 42 to a substantially open position, the air/fuel ratio is adjusted to increase the performance of the engine.

As shown in FIG. 1, a thermal switch 134 is operably coupled in circuit with the solenoid 118 and a power source 138 (e.g., a battery, a DC power source, or engine stator with full-wave bridge rectifier to provide DC output). The thermal switch 134 may be surface mounted to any of the exhaust components of the engine (e.g., the muffler), or positioned in the exhaust stream of the engine (e.g., in an exhaust manifold of the engine), to detect the exhaust temperature of the engine, which is indicative of the operating temperature of the engine. The thermal switch 134 is also responsive to ambient temperature. As schematically illustrated in FIG. 1, the thermal switch 134 is normally open, such that the solenoid 118 remains de-energized when the ambient temperature or exhaust temperature of the engine is below a predetermined value (e.g., during an initial cold start of the engine or engine restart). After the ambient temperature or exhaust temperature of the engine reaches the predetermined value, however, the thermal switch 134 closes to complete the circuit between the power source 138 and the solenoid 118 to energize the solenoid 118, which, in turn, pivots the choke lever 46 to the position shown in FIGS. 5 and 6. During a hot-restart of the engine, the thermal switch 134 will be closed above the predetermined temperature value. As such, immediately upon engine starting, power is supplied to the solenoid 118 to energize the solenoid 118, which will pivot the choke lever 46 to the position shown in FIGS. 5 and 6 to maintain the choke valve 42 in its substantially-opened position. Such a thermal switch 134 may be configured as a snap-action bimetal temperature control switch available from Therm-O-Disc, Inc. of Mansfield, Ohio (www.thermodisc.com). Alternatively, the solenoid 118 may be controlled in any of a number of different ways besides using the thermal switch 134 to selectively pivot the choke lever 46 and maintain the choke valve 42 in its substantially-opened position.

Figure 8:
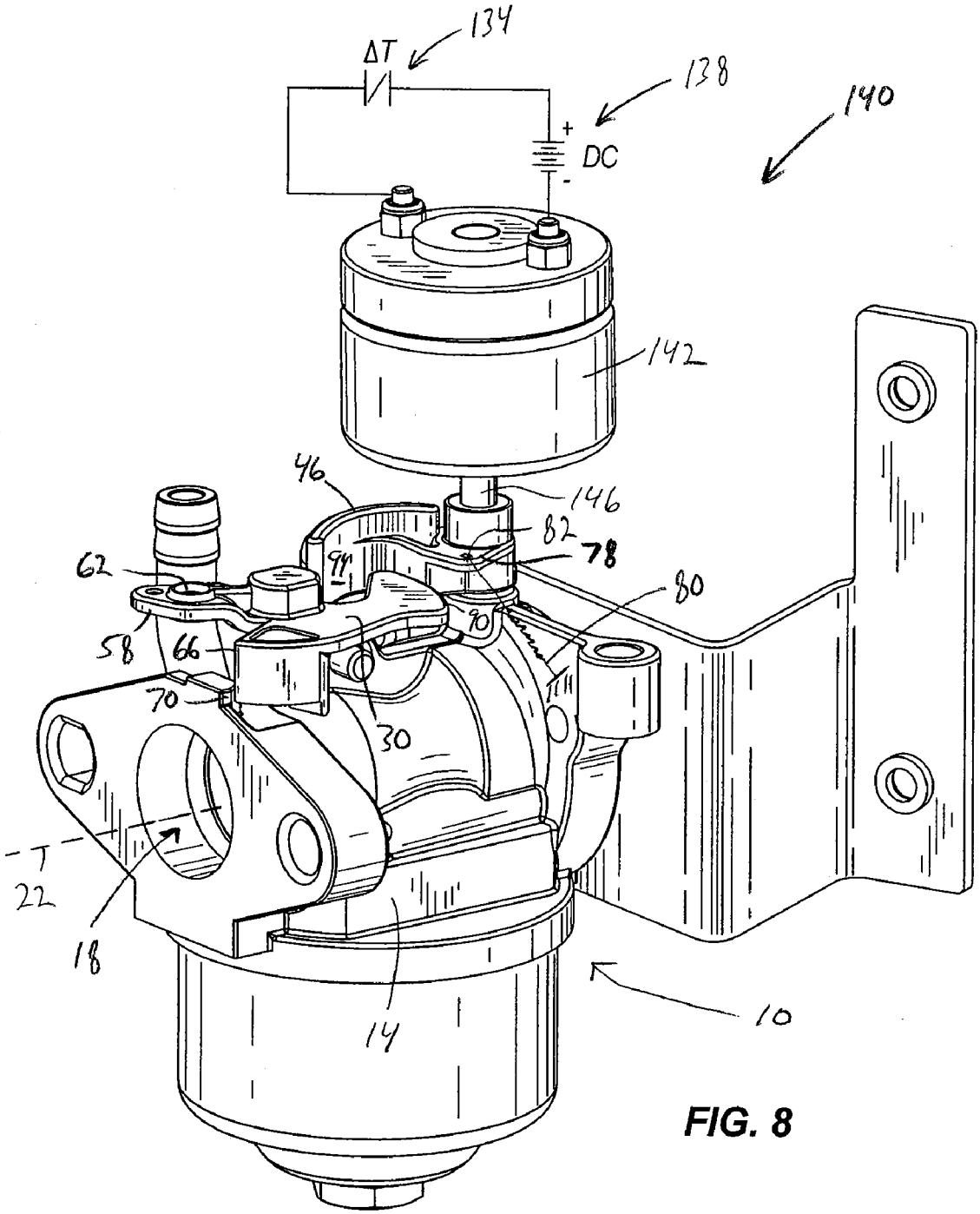
FIG. 8 is a rear perspective view of an alternative construction of an air/fuel mixing device of the present invention including a carburetor and solenoid, illustrating a throttle valve in its fully-opened position and a choke valve in a fully-closed position.

With reference to FIG. 8, an alternative construction of an air/fuel mixing apparatus 140 is shown, with like components labeled with like reference numerals. The apparatus includes a rotary solenoid 142 having an output shaft or armature 146 of the solenoid 142 directly coupled to the choke lever 46 and coaxial with the axis 54. As a result, upon actuation of the solenoid 142, the choke lever 46 and choke valve 42 co-rotate with the armature 146 of the solenoid 142. As shown in FIG. 8, the tip of the output shaft or armature 146 of the solenoid 142 and a bore in the choke lever 46 is circular, and a key and keyway arrangement between the tip of the armature 146 and the choke lever 46 may be utilized to rotatably fix the choke lever 46 to the armature 146 of the solenoid 142. Alternatively, the tip of the output shaft or armature 146 of the solenoid 142 may be noncircular, and may be tightly received within a corresponding noncircular bore defined in the choke lever 46 to fix the choke lever 46 for rotation with the armature 146 of the solenoid 142.

With reference to FIGS. 1 and 5, the solenoid 118 is supported relative to the carburetor 10 by a bracket 150 coupled to a portion of the engine (e.g., the carburetor 10 itself). The bracket 150 also functions as a heat sink to reduce overheating of the windings of the solenoid 118 and potential vapor locking of the carburetor 10. Alternatively, the solenoid 118 may be supported relative to the carburetor 10 using any of a number of different structures. Although not shown in FIG. 8, the solenoid 142 may be supported relative to the carburetor 10 by a bracket similar to the bracket 150 of the first embodiment.

Various features of the invention are set forth in the following claims.

What is claimed is:

1. An air/fuel mixing apparatus configured for use with an internal combustion engine, the air/fuel mixing apparatus comprising:

a carburetor including a body defining a passageway therein;

a throttle lever including a cam surface;

a throttle valve positioned in the passageway and responsive to movement of the throttle lever;

a choke lever including a follower surface configured to be engaged by the cam surface;

a choke valve positioned in the passageway and responsive to movement of the choke lever and the throttle lever; and a solenoid configured to disengage the choke lever from the throttle lever, and move the choke valve to a substantially-opened position.

2. The air/fuel mixing apparatus of claim 1, further comprising a lever operably coupled to the solenoid, wherein the solenoid lever is configured to disengage the choke lever from the throttle lever, and move the choke valve to its substantially-opened position, upon actuation of the solenoid.

3. The air/fuel mixing apparatus of claim 2, wherein the solenoid lever is rotatable by the solenoid about a first axis, wherein the choke lever is rotatable relative to the body about a second axis, and wherein the first axis is offset from the second axis.

4. The air/fuel mixing apparatus of claim 2, wherein the choke lever includes a second follower surface, and wherein the solenoid lever includes a cam surface configured to engage the second follower surface.

5. The air/fuel mixing apparatus of claim 4, wherein the second follower surface is disposed adjacent the first follower surface.

6. The air/fuel mixing apparatus of claim 2, wherein the solenoid includes an output shaft rotatable about an axis, and wherein the solenoid lever is formed as a single piece with the output shaft.

7. The air/fuel mixing apparatus of claim 1, wherein the solenoid includes an output shaft rotatable about a first axis, wherein the choke lever is rotatable relative to the body about a second axis, and wherein the first axis is coaxial with the second axis.

8. The air/fuel mixing apparatus of claim 7, wherein the output shaft is coupled to the choke lever and fixed for co-rotation with the choke lever.

9. The air/fuel mixing apparatus of claim 1, further comprising a thermal switch operably coupled to the solenoid, wherein the switch is configured to be selectively closed to provide power to the solenoid.

10. The air/fuel mixing apparatus of claim 1, wherein the throttle valve is configured to rotate about a first axis from a wide-open first position to a second position, wherein the cam surface includes an arcuate segment having a constant radius centered on a second axis, and wherein the arcuate segment is sufficiently long such that the throttle valve is configured to move at least 15 degrees while the follower surface engages the arcuate segment of the cam surface.

11. The air/fuel mixing apparatus of claim 1, wherein the throttle valve is configured to rotate about a first axis from a wide-open first position to a second position, wherein the choke valve is configured to rotate about a second axis from a substantially closed first position, corresponding to the wide-open first position of the throttle valve, to a partially-opened position, corresponding to the second position of the throttle valve.

12. The air/fuel mixing apparatus of claim 11, wherein the solenoid is configured to move the choke valve from its partially-opened position, in which the choke lever is engaged with the throttle lever, to its substantially-opened position, in which the choke lever is disengaged from the throttle lever.

13. The air/fuel mixing apparatus of claim 1, further comprising a bracket supporting the solenoid relative to the carburetor.

14. The air/fuel mixing apparatus of claim 13, wherein the bracket is coupled to the carburetor.

15. The air/fuel mixing apparatus of claim 1, wherein the solenoid is configured as a rotary solenoid.

* * * * *